United States Patent [19]

Wang

[11] 4,174,040

[45] Nov. 13, 1979

[54] MULTI-FUNCTIONAL SUPPOSITORY ENCAPSULATOR

[76] Inventor: Su-Yen Wang, 881, Section 1, Chung Shan Rd., Tachia Town, Taichung Hsien, Taiwan

[21] Appl. No.: 857,183

[22] Filed: Dec. 2, 1977

[51] Int. Cl.[2] ..... B65D 1/32

[52] U.S. Cl. ..... 206/529; 206/620; 206/820

[58] Field of Search ..... 206/529, 820, 484, 620

[56] References Cited

U.S. PATENT DOCUMENTS

| | | | |
|---|---|---|---|
| 2,530,127 | 11/1950 | Kubik | 206/529 |
| 2,791,324 | 5/1957 | Knoop | 206/484 |
| 2,797,805 | 7/1957 | Berard | 206/529 |
| 2,833,400 | 5/1958 | Lefebvre | 206/484 |
| 3,039,246 | 6/1962 | David | 206/529 |
| 3,144,343 | 8/1964 | Fritsche | 206/820 |

*Primary Examiner*—Stephen P. Garbe

*Attorney, Agent, or Firm*—Robert E. Burns; Emmanuel J. Lobato; Bruce L. Adams

[57] ABSTRACT

A multi-functional suppository encapsulator for molding, packing and administering suppositories comprising an inlet-guide groove having a plurality of identical, equally spaced holes perforated along bottom portion thereof; a plurality of container-bodies extending transversely from the convex outer surface of said groove, and having open ends thereof coaxially built-in with the peripheries of said holes individually so as to define therein bullet-shaped housings having smooth inner surface; a plurality of paired bridging strips in longitudinal alignment, with the longitudinal edges thereof parallel to said groove, each pair respectively formed on opposite sides of the close end of each said container-body and joining with adjacent pairs at ends of strips to form strip-junctures; and a plurality of recesses embed in-between and transversely to said pairs of bridging strips individually curving upward to a suitable distance along opposite sides of said close ends.

Said groove works with said container-bodies in molding molten suppository material into form and hermetically packing them individually therein to prevent from attack of moisture and air. Said trip-junctures and suitable tear-lines provided on said groove after sealed can be torn apart to separate said encapsulator into independent containers with suppositories therein. Said recesses will rupture when subject to extrusion by the contained suppositories. Rupture of said recesses is facilitated by either said strips or said groove or both working together.

Administration of suppositories fabricated by said encapsulator will be free from dosage loss and contamination of suppositories and patient-administrator cross-infections.

5 Claims, 11 Drawing Figures

MULTI-FUNCTIONAL SUPPOSITORY ENCAPSULATOR

BACKGROUND OF THE INVENTION

1. Field of the Invention

The present invention relates to a multi-functional suppository encapsulator for molding, packing and administering suppositories with the aim of providing suppositories of prolonged stability during storage and without dosage loss and contamination of suppositories and patient-administrator cross-infections when administered.

2. Description of the Prior Art

The pharmaceutical and medical industry conventionally uses four kinds of containers for suppositories. The first kind of which is made of aluminum foil which is not resilient enough to prevent dents caused by accidental crush or depression. Consequently, both the containers and suppositores therein will be deformed to render the suppositories not suitable for use. It is not unusual that sometimes the deformation is so severe that separation of the deformed suppositories from their containers is handicapped, and the suppositories may even split in parts and/or with aluminum foil pinched therein which is quite harmful to the patient.

The second kind of containers is made of thin rigid plastic sheet in two vacuum-formed halves. Said two halves are then sealed by heat to form into a strip-container. Neither to form or seal nor to open such a kind of container is easy, due to excessive bonding between the halves. Usually, it is necessary to cut through the wall of the closed containers with a knife or scissors to get the suppositories therein out, thereby the integrity and smoothness of said suppositories will be destroyed. Furthermore, sometimes due to inadequate bonding the containers may split to expose, drop out or lose suppositories therein before administration. In the latter case the molded-in suppositories always bear fin-like side appendages which generally will cause great irritation and even bleeding in patients with hemorrhoid.

The third kind of containers, made of semi-rigid plastics, usually consists of a body together with a cap covered thereon. To separate a suppository from such a kind of container is a hard thing, especially for those that have undergone heat change process, i.e. melted and resolidified. Moreover, to be packed in such kind of containers, the suppositories should be separately molded in form in a suitable metallic mold, then packed individually by hand manipulation, which is susceptible to contamination and results in high cost.

The fourth kind of containers is made of PE film. Suppositories are first molded in form in suitable molds, then individually packed in a piece of PE film by manual tie-up operation. This kind of containers has the same defects as the third kind. Besides, suppositories packed this way will easily reform into irregular shape when subject to heat change process, and become unusable.

In addition, these conventional types of containers have one more common disadvantage, that is, when used, they have to be held in the administrator's hand before insertion into the patient's anus. Upon contact with the administrator's hand, the suppository begins to melt subject to hand heat, (because the base of suppositories has a melting point below our body temperature), thus renders the suppository slippery and soft, and very unmanageable in administration. Now if the administrator is slow-motioned in operation, the suppository might have melted away quite a portion of its mass before it is put into the patient's body-cavity. This results in subdosage which is unpermissible in pharmaceutical practice. Besides, it is frequently found that the suppository is easily contaminated this way, if the administrator's hand is not clean enough. This in turn causes the patient to be infected by the administrator. Furthermore there is another possibility of cross-infection between patient and administrator, when the patient happens to have some kind of infectious complications such as hepatitis, dysentery, enteritis, . . . etc. and the administrator is the patient's family member and does not wear protective rubber gloves, the administrator is liable to be infected by the patient. One final common drawback with conventional containers is that none of them provides a hermetical reservation package for the contained suppository, and thus air and moisture degradation attack to the contained suppository is unavoidable.

SUMMARY OF THE INVENTION

The primary object of the invention is to provide a multi-functional suppository encapsulator which can be used as molds for suppositories and subsequently hermetically pack the suppositories formed therein to prevent from attack of air or moisture.

The second object of the invention is to provide a soft and resilient suppository encapsulator having smooth inner surface and being resilient enough to prevent suppositories formed and packed therein from permanent damage caused by deformation when subject to heat change process or depression, and can reform said deformed suppositories into regular form suitable for medical use.

The third object of the invention is to provide a suppository encapsulator allowing the suppositories hermetically packed therein to be easily removed for administration in a way free from dosage loss, contamination and cross-infections.

The fourth object of the invention is to provide a suppository encapsulator for molding and packing suppositories, which can be mass produced at low cost.

BRIEF DESCRIPTION OF THE DRAWINGS

The novel features that are considered characteristic of the invention are set forth with particularity in the appended claims. The invention itself, however, both as to its constitution and its method of operation, together with additional objects and advantages thereof, will be understood from the following description of a preferred embodiment when read in connection with the accompanying drawings, wherein like reference characters indicate like parts throughout the several figures, and in which:

DETAILED DESCRIPTION OF THE PREFERRED EMBODIMENT

Figure 1:
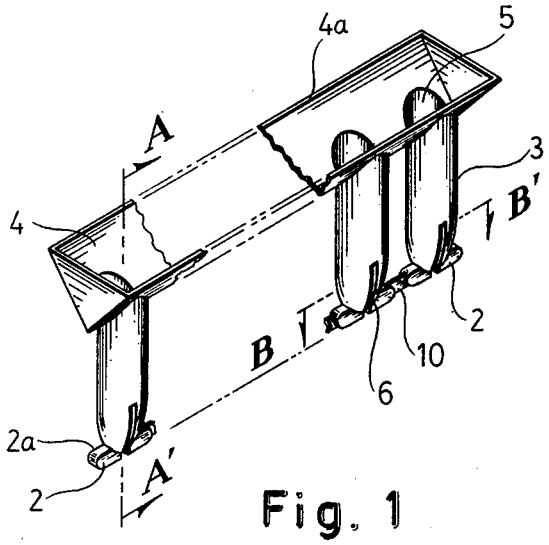
FIG. 1 is a perspective view of a portion of a multi-functional suppository encapsulator, according to the invention.
Figure 2:
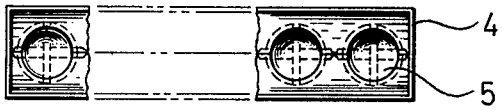
FIG. 2 is a top view of the encapsulator shown in FIG. 1.
Figure 3:
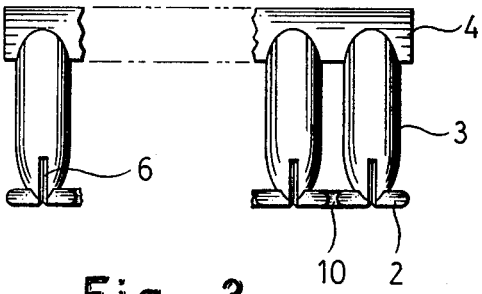
FIG. 3 is a front view of the encapsulator shown in FIG. 1.
Figure 4:
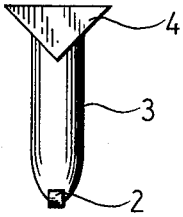
FIG. 4 is a side view of the encapsulator shown in FIG. 1.
Figure 5:
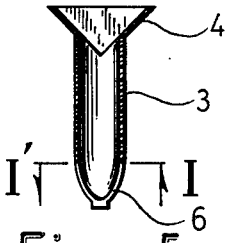
FIG. 5 is a sectional view taken along line A–A′ in FIG. 1.
Figure 6:
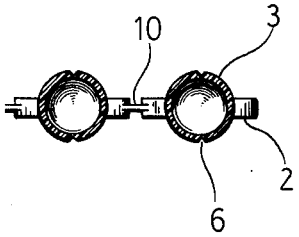
FIG. 6 is sectional view taken along line B–B' in FIG. 1.

Referring to FIG. 1, a multi-functional suppository encapsulator according to the invention, as shown, comprises an elognated inlet-guide groove 4 having a plurality of identical holes 5 equally spaced therein; a plurality of container-bodies 3 extending transversely from the convex outer surface of said groove 4 and with open ends thereof coaxially built-in the peripheries of said holes 5 individually so as to define therein bullet-shaped housings have smooth inner surface; a plurality of paired bridging strips 2 in longitudinal alignment and with their longitudinal edges 2*a* parallel to edge 4*a* of said groove 4, and each pair respectively formed at opposite sides of the closed end of each said container-body and joining to each other at strip-junctures 10; and a plurality of recesses 6, each of which is embeded transversely in between each paired strips 2, and extending from I to I' (as designated in FIG. 5) along the outer surface of said closed end.

To facilitate fabrication of suppositories, said encapsulator comprises more than two, preferably five or ten container-bodies 3, and which is integrally molded in form from soft, resilient and nontoxic suitable materials which are inert to suppositories and able to be handled in thermal sealing machines, high frequency or ultrasonic sealing machines and preferably are polymers such as plastisols for slush-molding or dipping process, thermoplastics for injection-molding or thermo-forming, and elastomers or any other suitable material. It should be noted that suitable inert fillers are necessary to be added to render said recesses 6 readily rupturable for opening.

The operation of molding, packing and administering suppositories by said encapsulator will be best understood from the following description with reference to FIGS. 7 to 11.

Figure 7:
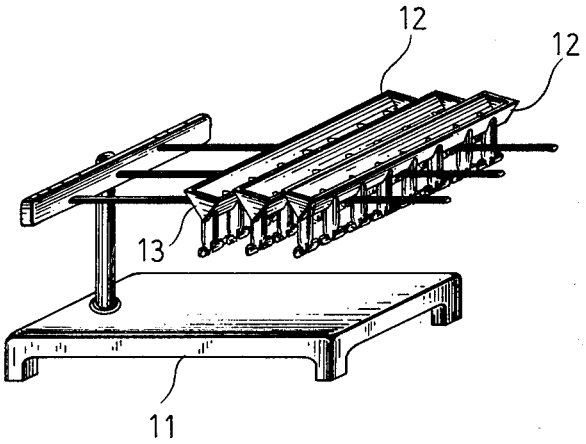
FIG. 7 is a perspective view of a support stand with said encapsulators thereon.

A support stand 11 carries, as shown in FIG. 7, three encapsulators thereon. Each encapsulator is titled with inner end 12 at a higher position than outer end 13 thereof when molten suppository material is being poured onto said groove 4 thereof. Said molten suppository material is gradually poured onto the inner end 12 of said groove of the first encapsulator, and the fluid will flow downward and outward to fill the container-bodies spaced along said groove in succession. Immediately after all the container-bodies are filled with the molten suppository material and then the groove is cleaned with a sterilized gauze, the filled encapsulator is set level. The other encapsulators are treated as the same way. When all encapsulators on the stand are filled with molten suppository material, they are placed into a refrigerator to solidify the suppositories and then subjected to a high frequency sealing machine to collapse and seal up the walls of said groove 4 into sealed form 4' (FIG. 8) having tear-lines 9 automatically formed thereon, whereby the encapsulator with container-bodies thereof hermetically sealed is ready for reservation and medical use.

In case the encapsulator is depressed or bent during transportation to cause said suppositories therein to be deformed or broken, it is only necessary to submerge the encapsulator in hot water for about thirty minutes and then transfer it to a refrigerator with said sealed groove 4' up for another thirty minutes said deformed suppositories will resume the original shape and be usable again.

Figure 8:
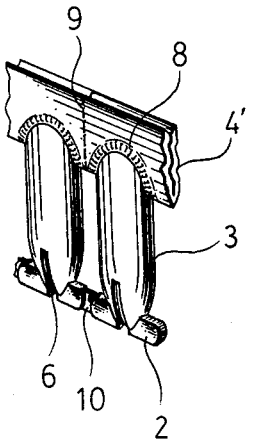
FIG. 8 is a perspective view of the encapsulator filled with suppositories and hermetically sealed.

When used, first, one usually separates the encapsulator into individual containers, as shown in FIG. 8, by tearing apart the strip-junctures 10 and corresponding tear-lines 9, and then ruptures said recess by suitable ways as described herein below to release the suppository from its container body for administration.

Figure 9:
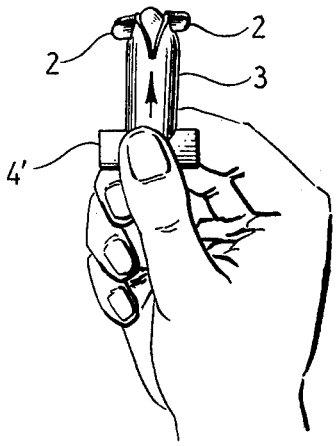
FIG. 9 is a drawing illustrating a preferred method to seperate a suppository from its container.

According to a first way, as shown in FIG. 9 an administrator may hold an independent container at the sealed groove thereof by his thumb and forefinger, and then nip and squeeze the contained suppository toward the recess end, i.e. the bottom of container body. As the pressure of squeeze increases, the recess will finally yield and rupture, and the suppository is extruded out of the resultant recess-opening. As the bullet-headed end of the suppository breaks through the recess opening, the administrator then insert the exposed suppository into a patient's anus, and continue extruding by progressively squeezing and pressing the container-body until the suppository is completely immerged into the anal duct. The administrator continues pressing the emptied container against the anus for a few seconds until the patient has no more alien sensation toward the inserted suppository, or has got used to it, then discards the empty container.

Figure 10:
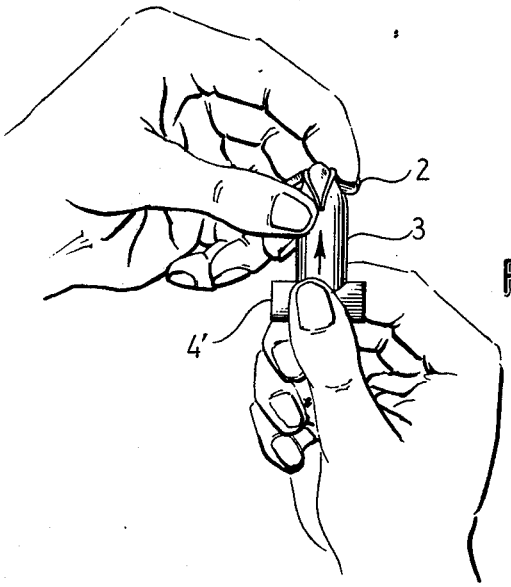
FIG. 10 is a drawing illustrating a second method to separate a suppository from its container.

In a second way as shown in FIG. 10, an administrator may hold the container in the same manner as described in the first method, however, instead of nipping and squeezing, he can press the bridging strips downward against his left hand's thumb and forefinger to rupture said recess there between and force the suppository to break through the recess. Then said suppository thus exposed is subject to same administration process as in the first way.

Figure 11:
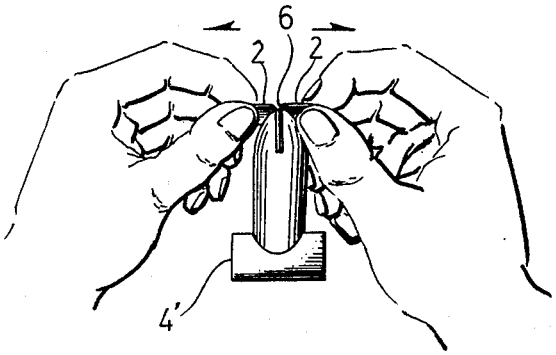
FIG. 11 is a drawing illustrating a third method to separate a suppository from its container.

In a third way, as shown in FIG. 11, an administrator may pull apart the paired strips to rupture said recess there between and expose said suppository through the resulting opening, and the same administration process as descriped above is followed. Any one of the three ways for administerring suppositories in said containers, as describered above, in which the first one is preferred due to its simplicity, will succeed in avoiding dosage loss and contamination of suppositories, and patient-administrator cross-infections such as generally occur with conventional types of suppository containers.

What is claimed is:

1. A multi-functional suppository encapsulator comprising:

an upwardly opening trough portion having a plurality of openings in the bottom thereof, a plurality of bullet-shaped container portions extending down from said openings of said trough portion respectively and having converging nose portions, and integral strips of material joining said nose portions of said container portions with one another, said strips being spaced from said trough portion, said trough portion, said container portions and said strips being integrally formed of soft, resilient non-toxic material, means defining separation lines extending transversely across said trough portion and said strips between said container portions for separation of said encapsulator into units each comprising a container portion and an appurenant section of said trough portion, and means defining rupture lines extending across the nose portions of said container portions to open said nose portions of container portions when ruptured for extrusion of a suppository therethrough, whereby molten suppository material poured into said trough portion flows into said container portions and solidifies therein to form suppositories, which, in use, are extruded through the ruptured nose portion of a container portion by application of digital pressure to said appurtenant section of said trough portion and an adjacent portion of said container portion.

2. A multi-functional suppository encapsulator according to claim 1, in which said strips when separated at said separation lines leave laterally projecting strip portions forming pull tabs at opposite sides of said nose portions of said container portions, said tabs being at opposite sides of a rupture line, whereby said nose portion can be opened by pulling on opposite tabs.

3. A multi-functional suppository encapsulator according to claim 1, in which opposite sides of said trough portion are brought together and united to seal upper ends of said container portions.

4. A multi-functional suppository encapsulator according to claim 1, formed of a soft, resilient, non-toxic material selected from the group consisting of plastisol, thermoplastics, and elastomers.

5. A multi-functional suppository encapsulator according to claim 1, in which said trough portion is of V-shaped cross section.

* * * * *